US007147494B2

(12) United States Patent
Lindner

(10) Patent No.: US 7,147,494 B2
(45) Date of Patent: Dec. 12, 2006

(54) PHYSICAL SECURITY SYSTEM FOR WIRELESS ACCESS POINTS THAT PREVENTS REMOVAL OF THE ACCESS POINT AND ASSOCIATED CONNECTORS

(75) Inventor: Leonard S. Lindner, Hudson, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/983,822

(22) Filed: Nov. 8, 2004

(65) Prior Publication Data

US 2005/0095885 A1 May 5, 2005

Related U.S. Application Data

(63) Continuation-in-part of application No. 10/266,377, filed on Oct. 8, 2002.

(51) Int. Cl.
*H01R 13/44* (2006.01)

(52) U.S. Cl. ..... 439/133

(58) Field of Classification Search ..... 439/133, 439/134, 149, 304, 535, 901; 70/14
See application file for complete search history.

(56) References Cited

U.S. PATENT DOCUMENTS 5,220,815 A * 6/1993 Davidge et al. ..... 70/14
6,454,579 B1 * 9/2002 Davis ..... 439/134

* cited by examiner

*Primary Examiner*—Chandrika Prasad
(74) *Attorney, Agent, or Firm*—Tucker Ellis & West LLP

(57) ABSTRACT

This invention is directed to a security system for wireless access points which includes a mounting bracket, an enclosure frame, a lock plate and a locking device. The mounting bracket couples the access point to a stationary surface. The enclosure frame is adapted to be fastened to the mounting bracket and configured to cover the mounting bracket. The lock plate is suitably adapted to secure the enclosure frame to the mounting bracket and to prevent access to either an I/O connector and/or a power connector. The locking device secures the lock plate to the mounting bracket and enclosure frame. When engaged by the locking device, the lock plate prevents removal of the access point and access to either the I/O connector and/or the power connector.

13 Claims, 10 Drawing Sheets

PHYSICAL SECURITY SYSTEM FOR WIRELESS ACCESS POINTS THAT PREVENTS REMOVAL OF THE ACCESS POINT AND ASSOCIATED CONNECTORS

This application is a continuation-in-part of U.S. patent application Ser. No. 10/266,377 filed Oct. 8, 2002, which is hereby incorporated by reference.

BACKGROUND OF THE INVENTION

This invention is directed to physical security systems for wireless access points. More particularly, this invention is directed to a physical security system for wireless access points which is comprised of a clamp assembly and a locking device.

Users of wireless access points are concerned about the physical security of distributed access points throughout their facilities. These security concerns include theft of the access points and hacking into the user's network via unauthorized access to the access point's I/O panel connectors, such as the Ethernet, fiber and/or console port connectors.

To address these security problems, access point users are placing the access points in metal security boxes to secure the access points. However, this solution results in other problems, such as degradation of the thermal design due to excessive heating of the access point which leads to lowered reliability, early product failure, and high warranty return costs. This solution also causes degradation and compromise of the electrical, electromagnetic compatibility, and regulatory certification of the access point. Further, it leads to destruction of the branding and esthetic design of the access point's standard enclosure as the brand name and design are hidden inside the metal box. In addition, the access point's visual indicators, such as the status indicators and the Ethernet indicators are hidden from the user. Furthermore, the installation of the security boxes is expensive and time consuming.

There is a need for a security system for wireless access points which overcomes these limitations.

SUMMARY OF THE INVENTION

In accordance with the present invention, there is provided a physical security system for wireless access points which overcomes the limitations of earlier security systems.

Further in accordance with the present invention, there is provided a security system for access points which prevents theft, I/O panel connector/antenna removal, and access to the ports by unauthorized users. Additionally, the security system does not hide the branding and esthetic design of the access point enclosure.

The security system comprises a clamp assembly and a locking device. The clamp assembly includes a spring loaded hinge pin which secures the two clamp assembly halves together. The clamp assembly is then clamped around at least one I/O panel connector, and then secured to the access point enclosure frame via a metal capture plate. The metal capture plate extends from an end of the clamp assembly and engages the lower half of the access point enclosure frame, securing the clamp assembly to the access point. Additionally, a locking device locks the clamp assembly halves in a closed position, thus preventing removal of the access point and blocking any unauthorized users from accessing the I/O ports.

Advantages of the security system, include, but are not limited to, easy and inexpensive installation, elimination of thermal degradation of the access point, does not compromise the ventilation of the access point enclosure, does not compromise the access point's electrical and regulatory aspects, and allows the visibility of all the access point's visual indicators.

These and other aspects of the present invention are herein described in further detail, with reference to the accompanying Figures, the illustrated embodiments being representative of only some of the ways in which the principles and concepts of the invention can be executed and employed.

DETAILED DESCRIPTION OF PREFERRED AND ALTERNATE EMBODIMENTS

Figure 1:
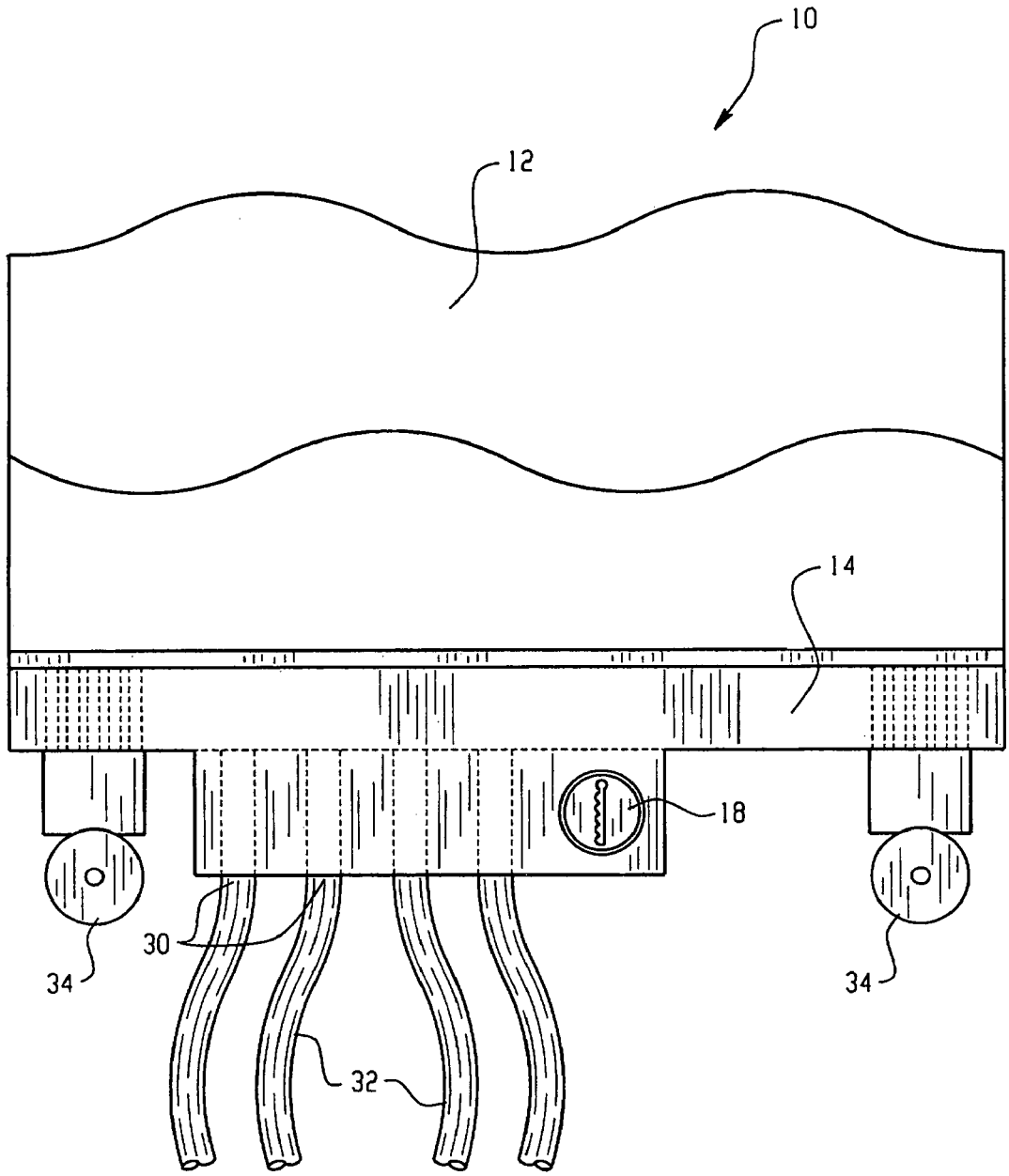
FIG. 1 is a top view of the security system of the present invention.

The present invention is directed to a physical security system for wireless access points. FIG. 1 shows a preferred embodiment of the system according to the present invention, generally designated 10. The system 10 comprises a clamp assembly 14 and a locking device 18 which are secured to an access point, to prevent theft of the access point and to prevent removal or access of the I/O panel connectors 32 and antennas 34 of the access point.

The clamp assembly 14 is designed to clamp around various I/O panel connectors, such as Ethernet connectors 32, fiber connectors 32, console port connectors 32, and/or antennas 34 connected to the access point. The clamp assembly 14 also securably attaches to a portion of the access point. This prevents removal of the access point, and physically blocks any unauthorized user from accessing the I/O ports.

In a preferred embodiment, a framing 12 encloses the access point protecting it from damage. The clamp assembly 14 is then secured to the access point enclosure frame 12, as an integral part of the access point enclosure frame 12. The clamp assembly 14 is secured around the connectors 32 and antennas 34 and then attached to the access point enclosure frame 12, preventing removal or access to the access point. In another embodiment, a "Kensington" lock-style hole is incorporated into the clamp assembly 14, allowing a dual-redundant lockup cable to further secure the access point enclosure frame 12. The "Kensington" lock is a locking device designed to lock into a small rectangular hole in the case of a small device, e.g., a laptop PC, to secure the device to a stationary object.

Figure 4:
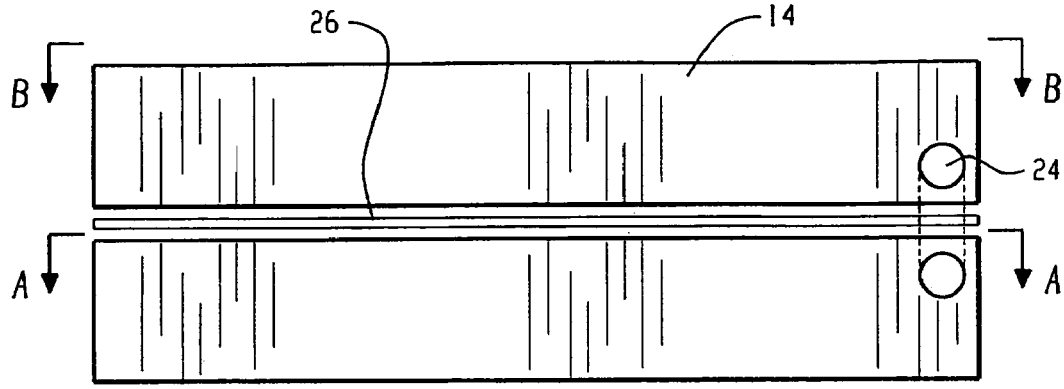
FIG. 4 is an elevation view of the clamp assembly of the present invention.
Figure 3:
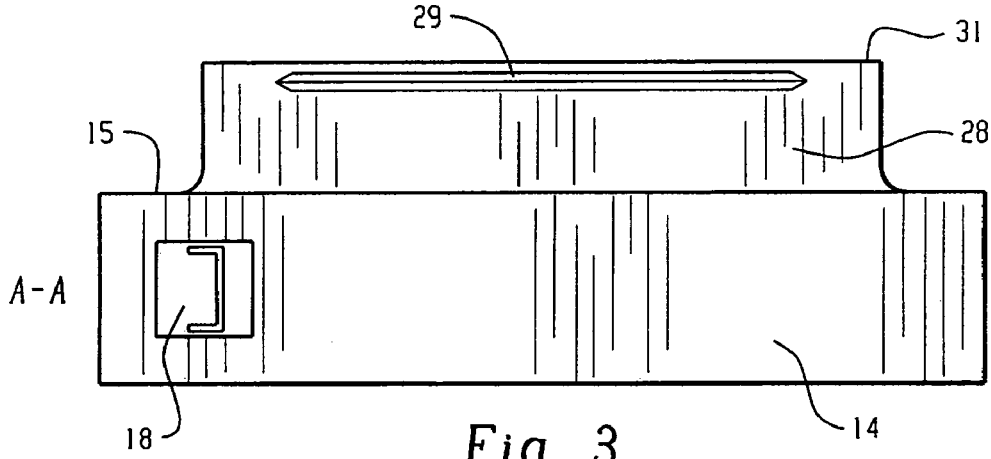
FIG. 3 is a bottom view of the clamp assembly of the present invention.
Figure 2:
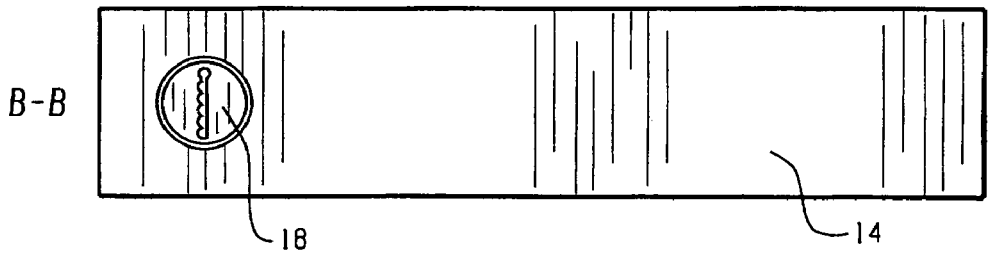
FIG. 2 is a top view of the clamp assembly of the present invention.

As shown in FIGS. 2–4, the clamp assembly 14 includes a top and bottom half secured together by a spring loaded hinge pin 24. The spring loaded hinge pin 24, normally holds the clamp 14 in an open position. A locking device 18 is needed to secure the two halves of the clamp 14 in a closed position. Additionally, the interior of the clamps 14 are covered with a soft insert 26 to protect the I/O panel connectors 32 positioned within the halves of the clamp assembly 14 from damage.

The clamp assembly 14 further contains openings 30 for securing the I/O panel connectors 32. These openings 30 retain the I/O connectors 32 and prevent removal of the connectors 32 by unauthorized users. Further, a soft insert 26 lines the interior of these openings 30, protecting the I/O connectors 32 from damage. Additionally, the clamp assembly 14 may contain openings for key pad access and/or for LED observation, depending on the wants and needs of the consumer.

As stated above, the clamp assembly 14 is held together by a locking device 18. The locking device 18 of the security system 10, is any suitable locking mechanism known in the art. Preferably, the locking device 18 is a cam lock 20, which is secured via a key. The locking device 18 prevents removal of the clamp assembly 14, once the clamp assembly 14 is clamped on the I/O connectos 32 and antennas 34. The cam lock engages the two halves of the clamp assembly 14, securing them together in a closed position. Then, the lock is secured via a key to prevent the clamp assembly 14 from opening.

Additionally, the locking device 18 is configurable for different levels of security, depending on the needs of the consumer. For example, a typical retail consumer would only require a low level of lock security, a commercial consumer would typically require a medium level of lock security, and a government, military, or banking consumer would require a high level of lock security. Therefore, the threat level would be matched to the locking device 18. For example, an inexpensive lock would be used for low level security consumers, and a pick-resistant lock would be used for high level security consumers.

In one embodiment, the clamp assembly 14 is secured around the I/O connectors 32 and then attached to the access point enclosure frame 12 as an integral part of the access point enclosure frame 12. The clamp assembly 14 is attached to the access point enclosure frame 12 via a capture plate 28 which extends from an end 15 of the clamp assembly 14, in the same plane. The capture plate 28 contains a ridge 29 at its end 31. This ridge 29 matingly engages a tab (not shown) on the lower half of the access point enclosure frame 12, connecting the clamp assembly 14 to the access point enclosure frame 12. Thus, when the clamp assembly 14 is secured around the I/O connectors 32 and locked in place, the capture plate 28 prevents removal of the clamp assembly 14 from the access point enclosure frame 12. The capture plate 28 also acts as a shield to protect tampering with the I/O connectors 32 between the clamp assembly 14 and the access point enclosure frame 12.

Figure 5:
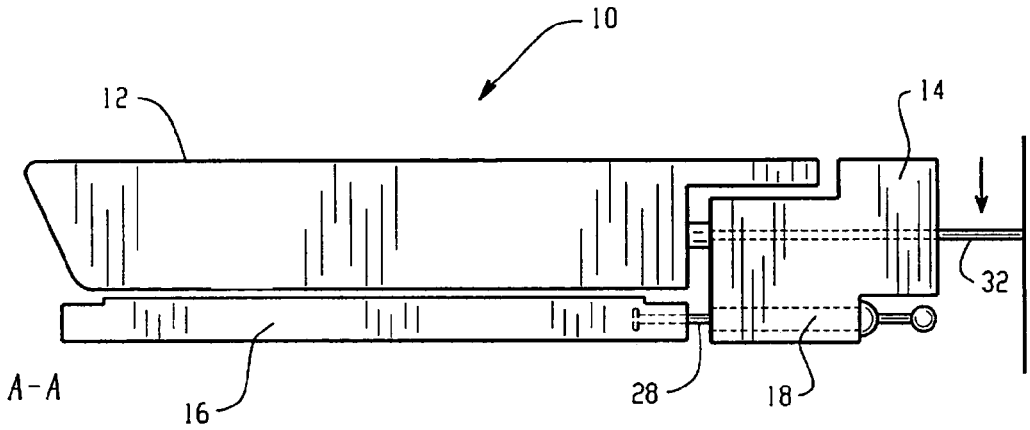
FIG. 5 is an elevation view of an alternative implementation of the security system of the present invention.

In another embodiment, the clamp assembly 14 is secured around the I/O connectors 32 and antennas 34 and then attached to a mounting bracket 16, which is then secured to the access point enclosure frame 12, as shown in FIG. 5. The mounting bracket 16 is attached to the lower half of the access point enclosure frame 12, allowing the access point enclosure frame 12 to be mounted in a desired location. The clamp assembly 14 is attached to a feature on the mounting bracket 16 via a cam attached to the locking device 18. Thus, when the clamp assembly 14 is secured around the I/O connectors 32 and antennas 34 and locked in place, the cam attached to the locking device 18 prevents removal of the clamp assembly 14 from the access point enclosure frame 12.

Figure 6:
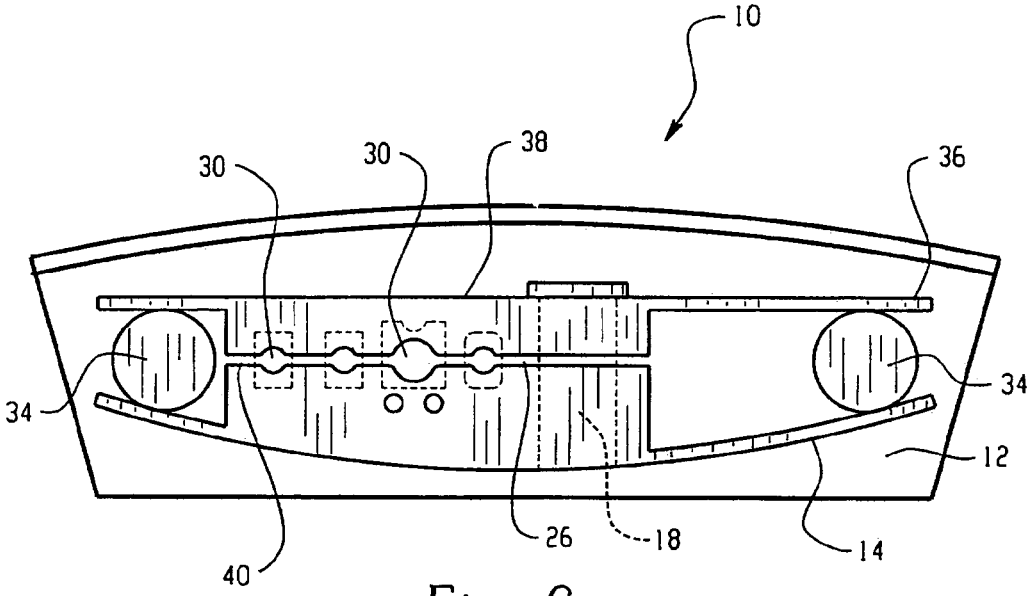
FIG. 6 is an elevation view of an alternative implementation of the security system of the present invention.

In another embodiment, the clamp assembly 14 is secured around the I/O connectors 32 and antennas 34, but is not attached to the access point enclosure frame 12 or mounting bracket 16, as shown in FIG. 6. A cover plate 38, a metal plate integral with the clamp assembly 14 is located at the top and bottom of the clamp assembly 14, which prevents removal of the I/O connectors 32 from their respective I/O ports on the access point enclosure frame 12. Additionally, metal extension "ears" or "outriggers" 36, an integral part of the clamp assembly 14, extend out over the antennas 34 to prevent removal of the antennas 34 from the access point enclosure frame 12. However, the clamp assembly 14 "ears" still permits the antennas 34 to rotate. Specifically, the "ears" capture a non-moving portion of the antennas 34 and allow the antennas 34 to rotate as they normally would without the security system attached. In this embodiment, a hook and relief 40, holds the two halves of the clamp assembly 14 together. As there is no connection to the access point enclosure frame 12 or the mounting bracket 16, the hook and relief 40 secures the clamp assembly 14 together, and the cover plates 38 prevent the disconnection of the I/O connectors 32 and antennas 34 from the enclosure frame 12, securing the access point assembly in place. The locking device 18 then locks the two halves of the clamp assembly together.

Figure 7:
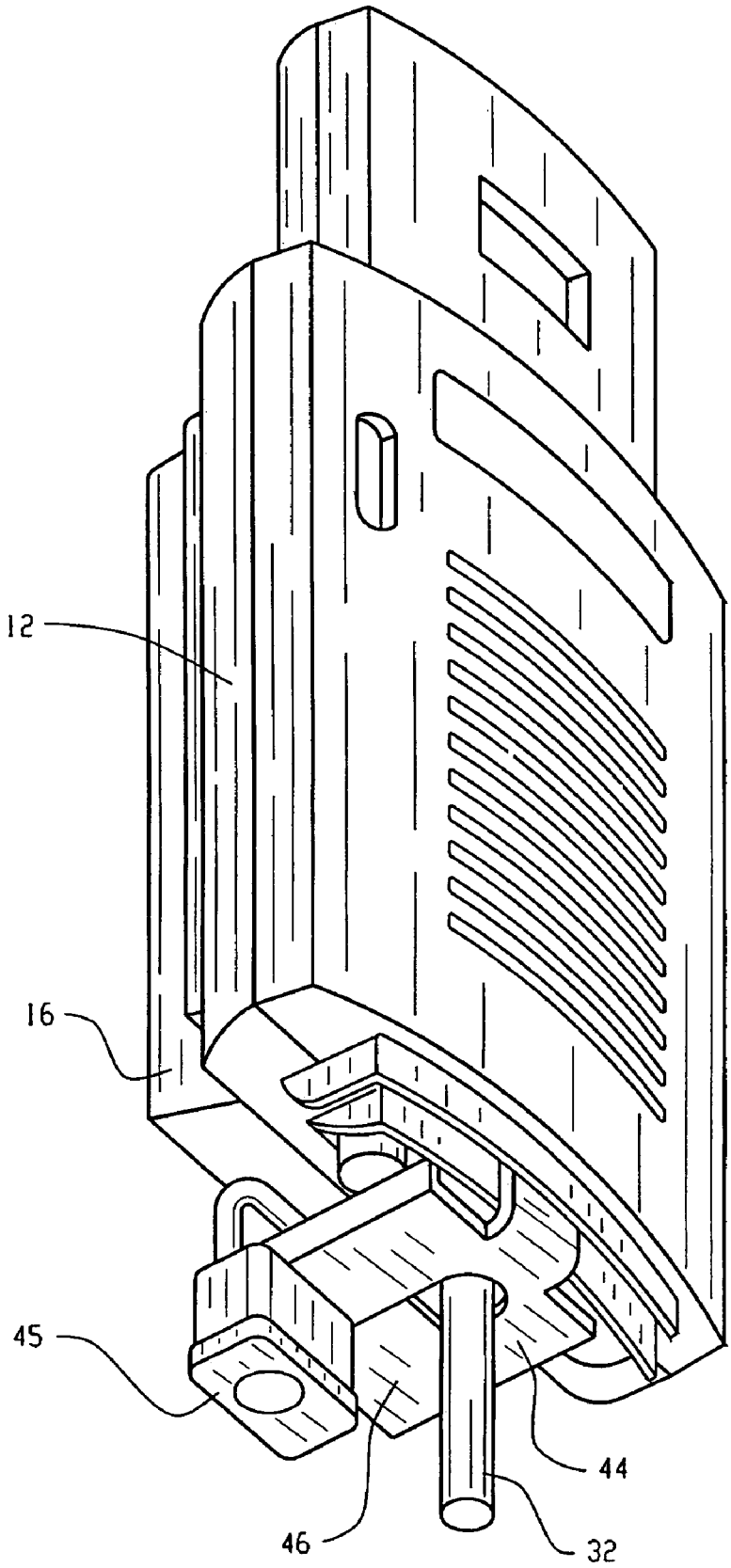
FIG. 7 is a perspective view of an alternative implementation of the security system of the present invention.

In another embodiment, a mounting bracket 16 is first attached to a stationary object in a desired location. The access point is then secured by engaging the access point enclosure frame 12 to the mounting bracket 16, as shown in FIG. 7. A lock plate 44 is then secured around the I/O connectors 32 and attached to the mounting bracket 16. The lock plate 44 matingly engages a "Kensington" lock-style hole 46 on the access point enclosure frame 12 and a pad lock 45 attaches to the lock plate 44 to secure the lock plate 44 in place. Thus, when the lock plate 44 is secured around the I/O connectors 32 and locked in place via the pad lock 45, the pad lock 45 attached to the lock plate 44 prevents removal of the lock plate 44 from the access point enclosure frame 12.

Figure 8:
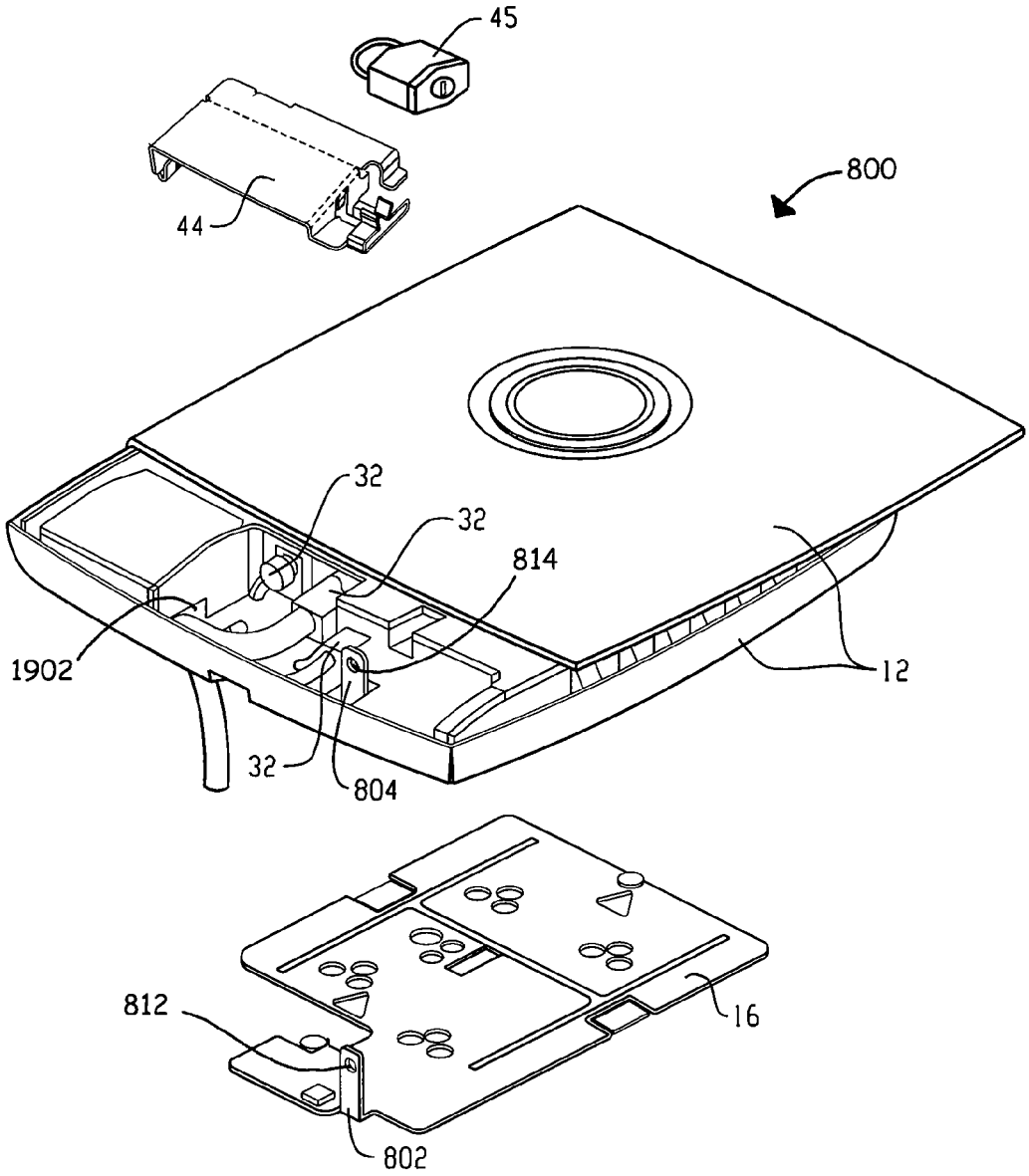
FIG. 8 is an exploded perspective view of an alternative emobidment of the security system.
Figure 9:
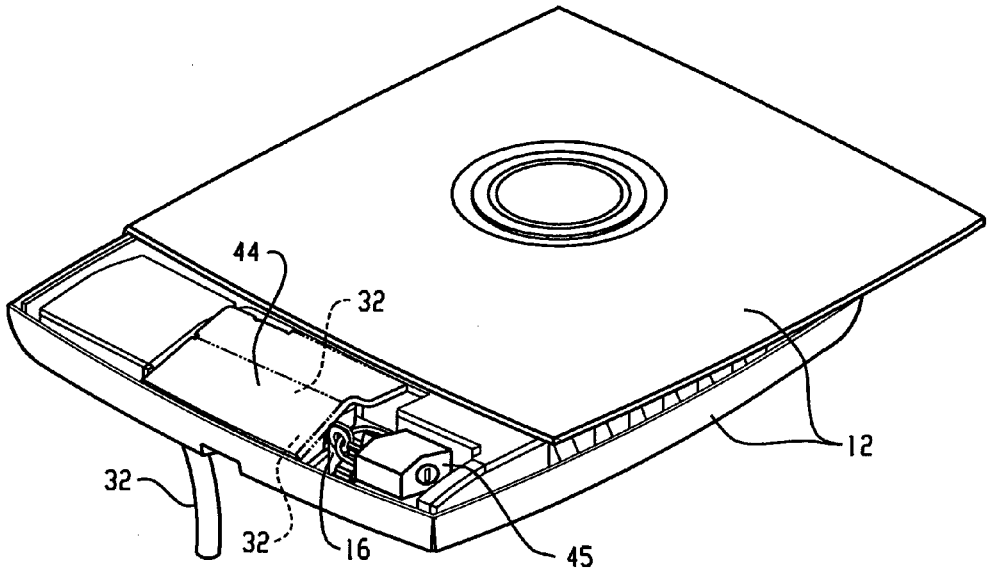
FIG. 9 is a perspective view of the alternative embodiment of the security system illustrated in FIG. 8.
Figure 10:
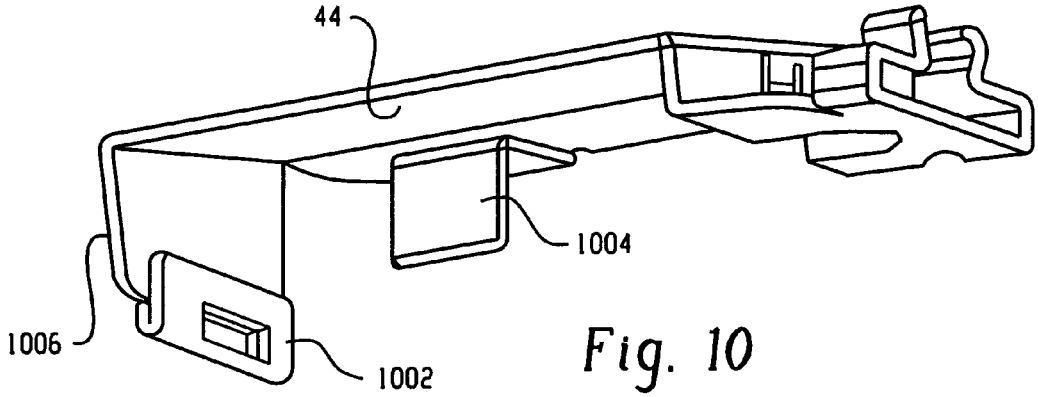
FIG. 10 is an isometric perspective view of a lock plate in accordance with an alternative embodiment of the present invention.
Figure 11:
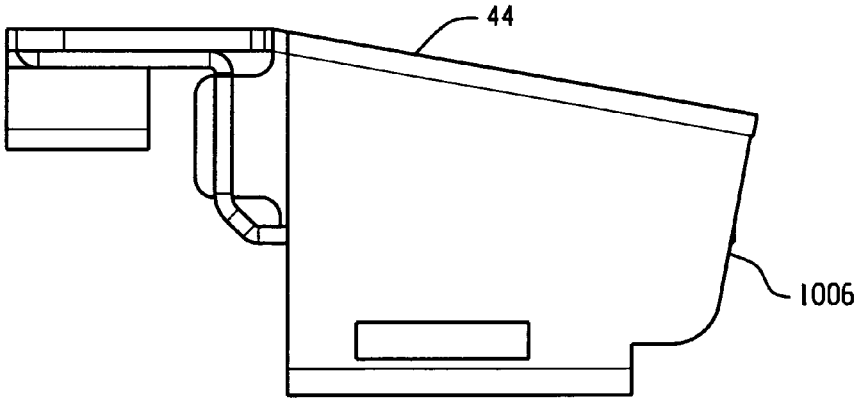
FIG. 11 is a side view of the lock plate illustrated in FIG. 10.
Figure 12:
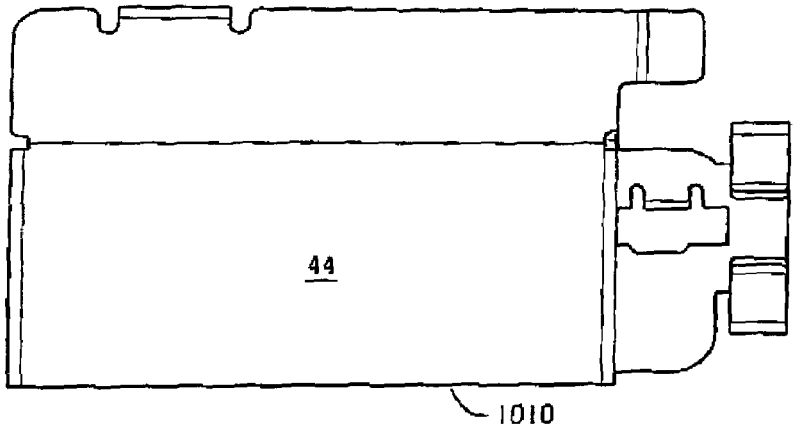
FIG. 12 is a top view of the lock plage illustrated in FIG. 10.
Figure 13:
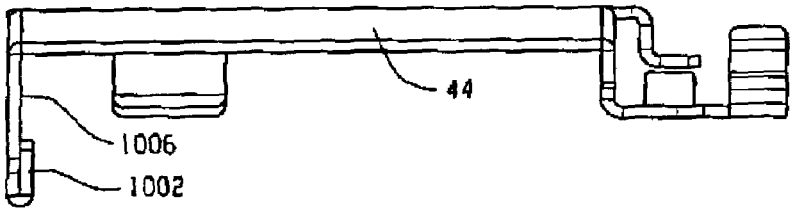
FIG. 13 is another side view of the lock plate illustrated in FIG. 10.
Figure 14:
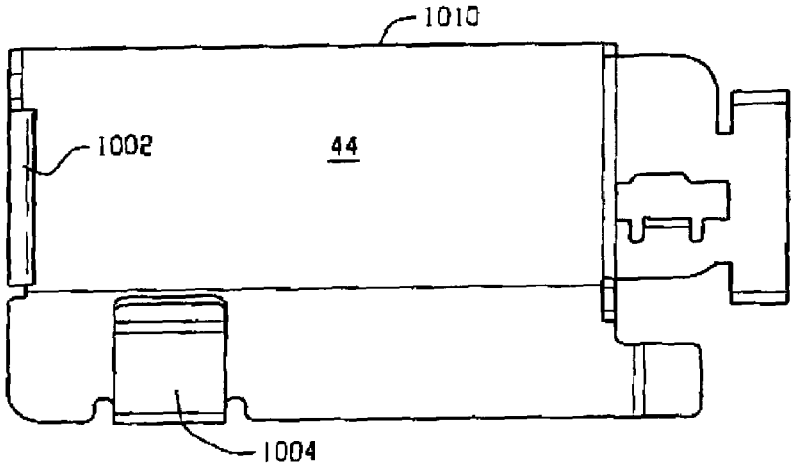
FIG. 14 is a bottom view of the lock plate illustrated in FIG. 10.
Figure 15:
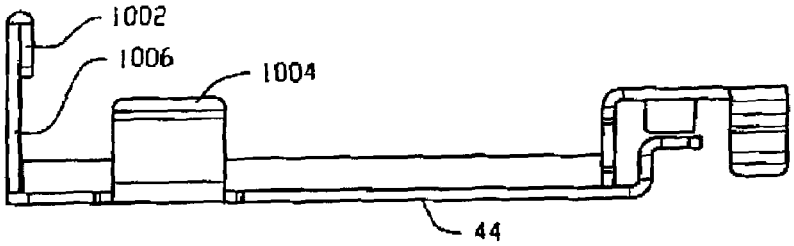
FIG. 15 is a bottom, side view of the lock plate illustrated in FIG. 10.
Figure 16:
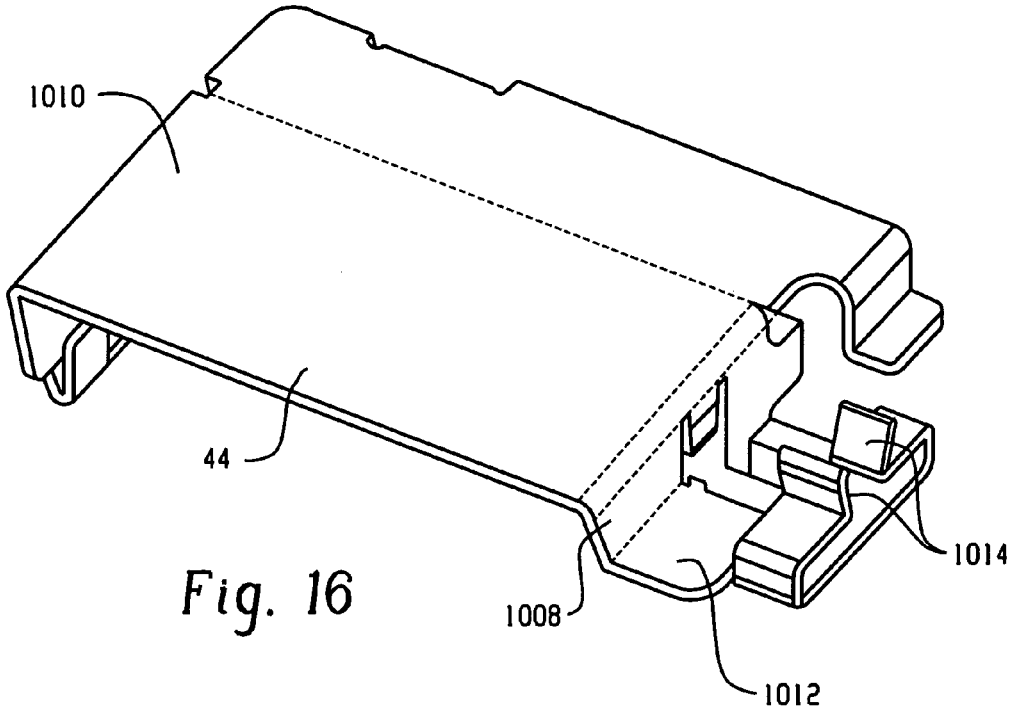
FIG. 16 is an alternative isometric, perspective view of the lock plate illustrated in FIG. 10.
Figure 17:
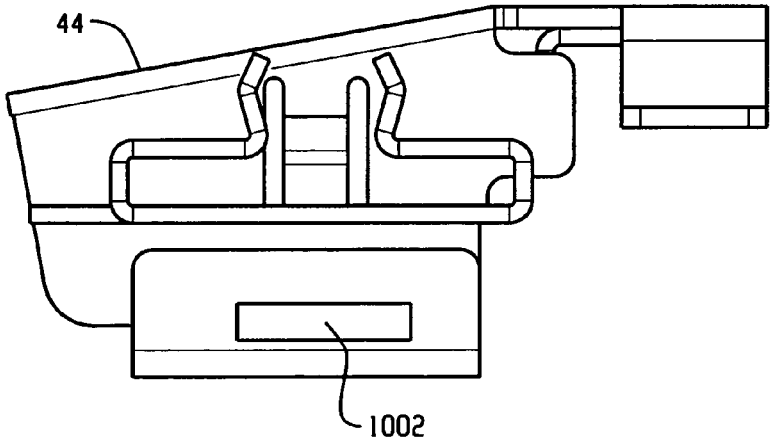
FIG. 17 is another side view of the lock plate illustrated in FIG. 10.
Figure 18:
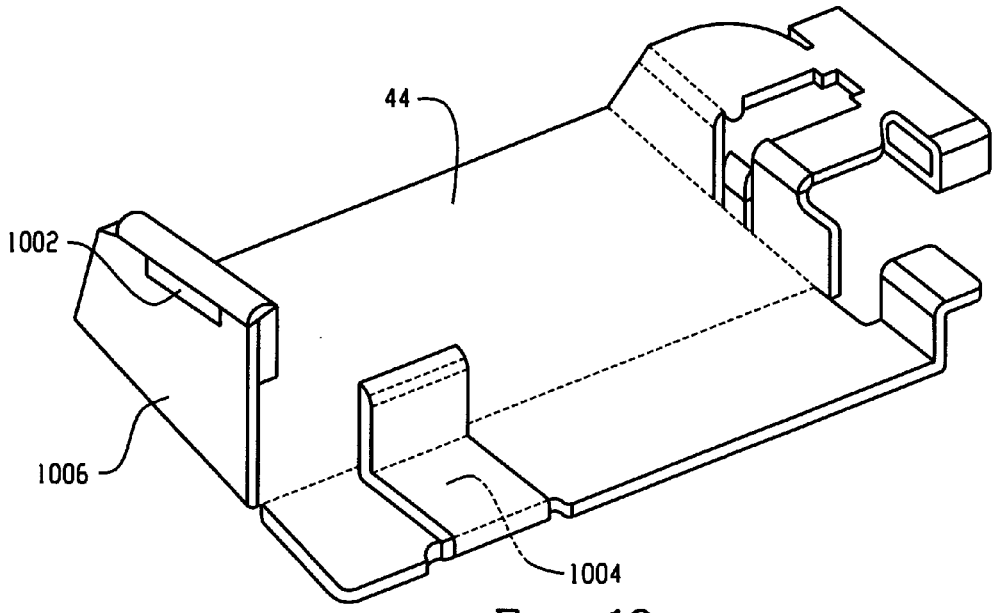
FIG. 18 is a bottom perspective view of the lock plate illustrated in FIG. 10.

Referring to FIGS. 8 and 9, in another embodiment, a mounting bracket 16 is first attached to a stationary object in a desired location. Access point 800 is secured by engaging the access point enclosure frame 12 to the mounting bracket 16, as shown in FIGS. 8 and 9. As will be described further herein (see description for FIG. 19), access point enclosure frame 12 comprises a protrusion or tab 1902. Lock plate 44 is then secured around the I/O connectors 32 and matingly engages the mounting bracket 16 and the access point enclosure frame 12. Lock plate 44 comprises a first side 1006 with an aperture 1002 that engages tab 1902 on access point enclosure frame 12. Lock plate 44 further comprises a second side 1008 that has a lower surface 1012 with tabs 1014 protruding therefrom. Pad lock 45 passes through apertures 812 and 814 on mounting bracket 16 and enclosure frame 12 respectively, encompasses tabs 1014 of lock plate 44 securing lock plate 44 in place (See FIG. 9). Thus, when the lock plate 44 is secured around the I/O connectors 32 and locked in place via the pad lock 45, the pad lock 45 attached to the lock plate 44 prevents removal of the lock plate 44 from the access point enclosure frame 12 and mounting bracket 16 and prevents access to I/O connectors 32.

Referring first to FIG. 8, there is illustrated an exploded view of an alternative embodiment of the present invention. Mounting plate 16 comprises a locking post 802 suitably adapted for engaging a locking device 45, e.g., a padlock. In addition, enclosure frame 12 also has a locking post 804. Referring now to FIG. 9, with continued reference to FIG. 8, when locking plate 44 is installed, padlock 45 engages locking post 802 of mounting plate 16 and locking post 804 of enclosure frame 12. A portion of enclosure frame 12 includes a cover 806, which is shown in the open position. Cover 806 is suitably adapted to slide along frame 12 and cover lock plate 44 and pad lock 45. As can be observed in FIG. 9. when locking plate 44 is installed, access to I/O connector 32 and power cable 1016 is blocked Referring now to FIGS. 10–18 with continued reference to FIGS. 8–9, there are several views of a locking plate 44 in accordance with an alternative embodiment of the present invention. Locking plate 44 can be formed by one piece of metal, or by using any malleable, yet sturdy material. Locking plate 44 comprises an apeture 1002 in a first side 1006. Tab 1004 is suitably adapted to secure cables (not shown), such as a power cable 1016 and a network cable 32 connected to the access point. When locking plate 44 is installed, tab 1004 prevents the cables from being physically removed from their respective connections. Locking plate further comprises a second side 1008. Second side 1008 is coupled to a lower surface 1012. Lower surface 1012 comprise tabs 1014. In operation, when locking plate 44 is ingalled as show in FIG. 9, padlock 45 covers lower surface 1012 and encompasses tabs 1014 (see 1018: FIG. 9), which prevents locking plate 44 from being removed once padlock has been engaged. Cover surface 1010 prevents access to the area underneath cover surface 1010 when locking plate 44 is engaged.

Figure 19:
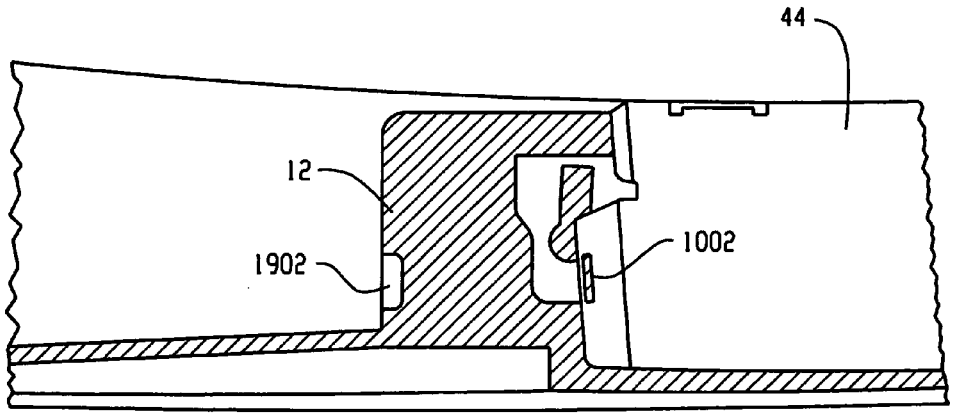
FIG. 19 is an exploded view illustrating how the lock plate engages the enclosure frame in an alternative embodiment of the present invention.

FIG. 19 illustrates how the first side 1006 of locking plate 45 engages enclosure frame 12. Locking plate 44 slides until apeture 1002 engages protrusion (tab) 1902. This prevents locking plate 44 from being lifted up via side 1006 when the locking plate is installed and engaged by padlock 45 to mounting bracket 16 and enclosure frame 12.

Although the preferred embodiment has been described in detail, it should be understood that various changes, substitutions, and alterations can be made therein without departing from the spirit and scope of the invention as defined by the appended claims. It will be appreciated that various changes in the details, materials and arrangements of parts, which have been herein described and illustrated in order to explain the nature of the invention, may be made by those skilled in the area within the principle and scope of the invention as will be expressed in the appended claims.

The invention claimed is:

1. A system for physically securing an access point, comprising:

a mounting bracket for coupling the access point to a stationary surface;

an enclosure frame adapted to be fastened to the mounting bracket and configured to cover the mounting bracket, the enclosure frame comprising a tab;

a lock plate suitably adapted to secure the enclosure frame to the mounting bracket and to prevent access to at least one of the group consisting of an I/O connector and a power connector, the lock plate comprising a first side with an aperture suitably configured for engaging the tab on the enclosure frame; and a locking device for securing the lock plate;

wherein when the locking device is engaged, it prevents the lock plate from being removed from the enclosure frame from and prevents the lock plate from being removed from the mounting bracket thereby preventing removal of the access point from the stationary surface.

2. The system of claim 1, further comprising:

the mounting bracket having a first locking post; and the enclosure frame having a second locking post;

wherein the locking device engages the first locking post and the second locking post.

3. The system of claim 1, further comprising:

the lock plate further comprising a tab, the tab suitably adapted to prevent access to at least one of the group consisting of an I/O connector and a power connector.

4. The system of claim 1, further comprising:

the lock pate further comprising first and second sides;

the second side comprising a lower surface adapted to engage the locking device when the locking device is engaged.

5. The system of claim 4, further comprising:

the lower surface having a lower surface tab;

wherein the lower surface tab is configured to be encompassed by the locking device to prevent the locking surface from being removed.

6. The security system of claim 1 wherein the I/O connector is selected from the group consisting of Ethernet connectors, fiber connectors, console port connectors, and antennas.

7. The security system of claim 1 further comprising the lock plate further comprising a cover surface, wherein the cover surface prevents removal of the at least one of the group consisting of an I/O connector and a power connector.

8. The security system of claim 7, the cover surface further comprising a tab adapted to prevent removal of the at least one of the group consisting of an I/O connector and a power connector.

9. A system for physically securing an access point, comprising:

a mounting means for coupling the access point to a stationary surface;

an enclosure means adapted to be fastened to the mounting means and configured to cover the mounting means, the enclosure means comprises a Protrusion means;

a locking cover means with an aperture means for engaging the protrusion means, the locking cover means is suitably adapted to secure the enclosure means to the mounting means and to prevent access to at least one of the group consisting of an I/O connector and a power connector; and a locking means for securing the locking cover means;

wherein when the locking means is engaged, it prevents the locking cover means from being removed from the enclosure means and prevents the locking cover means from being removed from the mounting means thereby preventing removal of the access point from the stationary surface.

10. The system of claim 9, further comprising:

the mounting means having a first locking post; and the enclosure means having a second locking post;

wherein the locking means engages the first locking post and the second locking post.

11. A method for physically securing an access point, comprising the steps of:

coupling a mounting plate to a stationary surface;

coupling an enclosure frame for the access point to the mounting plate, the enclosure plate comprising a tab;

covering an I/O panel adapter with a cover, the cover comprising a first side with an aperture suitable for engaging the tab on the enclosure frame; and securing the mounting plate, enclosure frame and cover with a locking device;

wherein when the locking device is engaged, the locking device fastens the cover and the enclosure frame to the mounting plate and thereby prevents removal of the access point from the stationary surface.

12. The method of claim 11, wherein the coupling an enclosure frame further comprises covering the mounting plate such that fasteners attaching the mounting plate to the stationary surface are covered.

13. The method of claim 11, further comprising:

the cover having a second side with a lower surface; and the locking device engaging the lower surface to prevent removal of the cover.

* * * * *